US005928067A

United States Patent [19]

Hopper et al.

[11] Patent Number: 5,928,067

[45] Date of Patent: Jul. 27, 1999

[54] HEADBOX APRON FINISHING AND LAPPING DEVICE

[75] Inventors: Walter D. Hopper, Beloit, Wis.; Eugene D. Neill, So. Beloit, Ill.; Timothy W. Mecca, Janesville, Wis.; Paul D. Harris; Ronald L. Radke, both of Beloit, Wis.; Charles L. McCool, Janesville, Wis.

[73] Assignee: Beloit Technologies, Inc., Wilmington, Del.

[21] Appl. No.: 08/949,628

[22] Filed: Oct. 14, 1997

[51] Int. Cl.[6] ..... B24B 7/00

[52] U.S. Cl. ..... 451/259; 451/548; 451/490

[58] Field of Search ..... 451/259, 490, 451/548, 158, 10, 11, 49

[56] References Cited

U.S. PATENT DOCUMENTS

| | | | |
|---|---|---|---|
| 970,618 | 9/1910 | Gardner | 451/548 |
| 4,517,056 | 5/1985 | Roerig et al. . | |
| 5,197,230 | 3/1993 | Simpfendorfer et al. | 51/165.77 |
| 5,567,273 | 10/1996 | Offerhaus et al. . | |
| 5,615,437 | 4/1997 | Takahashi et al. | 15/98 |

FOREIGN PATENT DOCUMENTS 2121967 4/1994 Canada .

OTHER PUBLICATIONS

Beloit Corporation, "AccuFlat Finishing."

*Primary Examiner*—David A. Scherbel
*Assistant Examiner*—Dung Van Nguyen
*Attorney, Agent, or Firm*—Raymond Campbell; Gerald Mathews

[57] ABSTRACT

A lapping assembly is described wherein a lapping process is performed to provide a flat headbox apron floor. The lapping assembly includes an eight-legged fly-style plate and a spring loaded floating driver. The lapping assembly and operation consists of attaching a spring loaded floating driver to a machine spindle of a milling machine. A lapping fly wheel is attached to the spring loaded floating driver. A coated abrasive strip with desired grit size to achieve the desired finished results is clamped in place on the lapping fly wheel. The machine spindle is rotated, thereby rotating the spring loaded floating driver and the lapping fly wheel, and the grinding and lapping of the apron floor can begin.

9 Claims, 8 Drawing Sheets

HEADBOX APRON FINISHING AND LAPPING DEVICE

BACKGROUND OF THE INVENTION

1. Field of the Invention

The present invention relates to a lapping apparatus used in finishing, and polishing paper machine headbox components, and relates more particularly to lapping an apron floor or apron lip of a paper machine headbox.

2. Description of the Prior Art

Paper produced by paper machines is often subject to problems such as barring, streaking or ridging in its final form. Many of these problems can be traced to basis weight streaks caused by an uneven jet of paper stock coming out of a headbox. It has been determined that subtle variations in an apron floor in a headbox can have a significant negative impact on basis weight profile.

Conventionally, a headbox apron floor is finished in a sequence of planing or milling, grinding, mechanical polishing, electro-polishing and even lapping to produce a more uniform flat surface. Recently, lapping has gained acceptance as the preferred method to achieve desired flatness and finish, to prevent basis weight streaks or other related problems.

U.S. Pat. No. 5,567,273 and Canadian Patent No. 2,121,967 (both of which are hereby incorporated by reference herein) describe a method of reducing surface irregularities in paper machine headbox components in order to prevent streaking and other degradation of paper produced. In these prior art patents, certain lap tools are described which are used to accomplish the method of lapping a surface, namely, headbox components.

Prior art lap tools, like those described in the mentioned prior art patents, are generally solid circular plates which are operationally connected to a milling machine. The milling machine rotates the lap tool over the piece being lapped during the lapping operation. The lap tool and the piece being lapped generally move in a linear direction, one with respect to the other. On the working surface of the lap tool, namely, the surface which is driven over and on the piece being lapped, circular sand paper disks, commonly referred to as "daisies", are adhesively attached. These daisy sand paper disks are common articles of commerce and can be obtained from any number of sand paper suppliers, such as, for example, 3M or Buehler. The circular daisy sand paper disks are generally located in a circular pattern around the periphery of the lap tool. However, due to the speeds and pressures needed to obtain the required surface finish on the apron floor, it has been found that the prior art daisy sand paper disks do not hold up well under normal operating conditions. Many times, the daisy pads wear out too quickly and/or easily come off of the lap tool. Such results are unacceptable in that there is metal to metal contact between the lap tool and the piece being lapped. Because of the problems associated with using stick-on adhesive lapping sand paper pads, machine operators run the lap tool at slower than optimal speeds and pressures, thereby increasing machine cycle time, which results in excessive operating costs associated with lapping a particular piece.

Prior art lap tools, like those described in the previously mentioned patents, are driven by a standard milling machining tool driver. Such prior art drivers are ridged, one-piece constructions that are attached to the milling machine and the lapping tool. When driving a lapping tool over a surface, the milling machining exerts a pressure between the lapping tool and the piece being lapped. Because the tool driver is of a ridged, one-piece construction, if it is lowered down onto the piece being lapped too quickly or too much pressure is exerted, the apron floor or piece being lapped can be damaged by being gouged. Such damage is extremely detrimental to an apron floor and must be fixed to prevent the problems previously mentioned that can occur in the final paper product. Because of the high degree of flatness and surface finish requirements in apron floor surfaces, in order to prevent basis weight streaks, fixing such damage by smoothing out gouges is extremely costly and requires extensive machining time.

What is needed is a lapping tool which eliminates the heretofore mentioned problems. What is needed is a lapping tool which reduces machining cycle time by using a more aggressive grind and lapping material. Such a tool must be able to withstand higher operating speeds and pressure than heretofore obtained. Additionally, what is needed is a lapping tool which does not gouge a surface being lapped when lowered down onto the surface either too quickly or at too high a pressure.

SUMMARY OF THE INVENTION

The solution to reducing machining cycle time consists of using existing coated abrasive belts cut into short rectangular sections rather than the self-adhesive daisy pads previously utilized. The short rectangular abrasive pads are mechanically clamped to a special eight legged fly style plate of a lapping assembly according to the present invention. No longer are the abrasive pads adhesively fixed to the working surface of a lap tool.

The fly style plate is provided with a spring loaded floating driver to prevent the surface being lapped from being gouged when the lapping assembly is lowered onto the surface to be lapped. Not only does the spring loaded floating driver allow for adjustable loads to be applied in the lapping process, thereby enhancing aggressive grinding or lapping by increasing the pressures applied during the lapping process, the spring loaded mechanism allows the lapping assembly to yield slightly when pressure is applied between the lapping assembly and the surface being lapped.

The fly style plate with its improved means for attaching an abrasive pad to its lapping surface, and the spring loaded floating driver which allows for increased pressures to be utilized during a lapping process and which minimizes damaging the surface to be lapped, reduces machine cycle lapping times from an average of 200 hours per piece to 60 hours per piece and still obtains the desired specifications of the surface being lapped or finished.

Accordingly, it is a feature of this invention to lower machining cycle times in a lapping process by utilizing a lapping tool that can withstand speeds and pressures heretofore not achieved in a quick and easy manner.

Another feature of the invention is to provide a means which will allow reduction in machine cycle time to finish apron floor surfaces by as much as 60% in some operations, while still holding specified flatness and surface finish tolerance requirements.

A further feature of the invention is to improve the attaching means for an abrasive belt to a lapping tool so that higher speeds and pressures can be applied to a lapping assembly without wearing out the abrasive material.

Yet another feature of the invention is to provide a means which will prevent gouging of apron floor surfaces when a lapping assembly is lowered onto a surface to be lapped or too high a pressure is exerted between a lapping tool and the surface being lapped.

Still another feature of the invention is to provide a lapping tool to finish grind and lap paper machine headbox components, particularly, apron floors, to a required flatness of 0.0002 inches and required finish of 4 rms or better.

These and other objects, features and advantages of the invention will become readily apparent to those skilled in the art upon reading the description of the preferred embodiment, in conjunction with the attached drawings.

DESCRIPTION OF THE PREFERRED EMBODIMENTS

Figure 1:
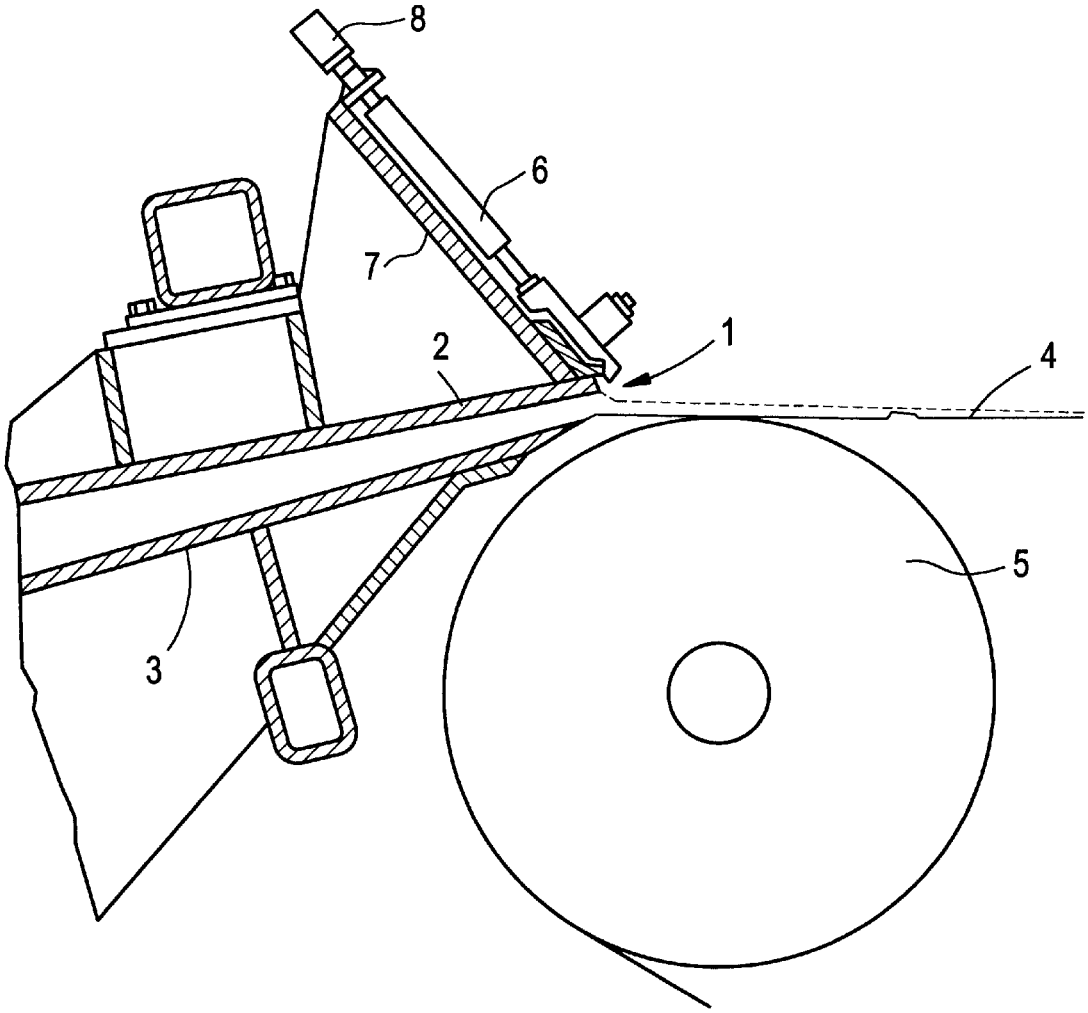
FIG. 1 is a cross-section illustration of a paper machine headbox slice area, showing its various components.
Figure 2:
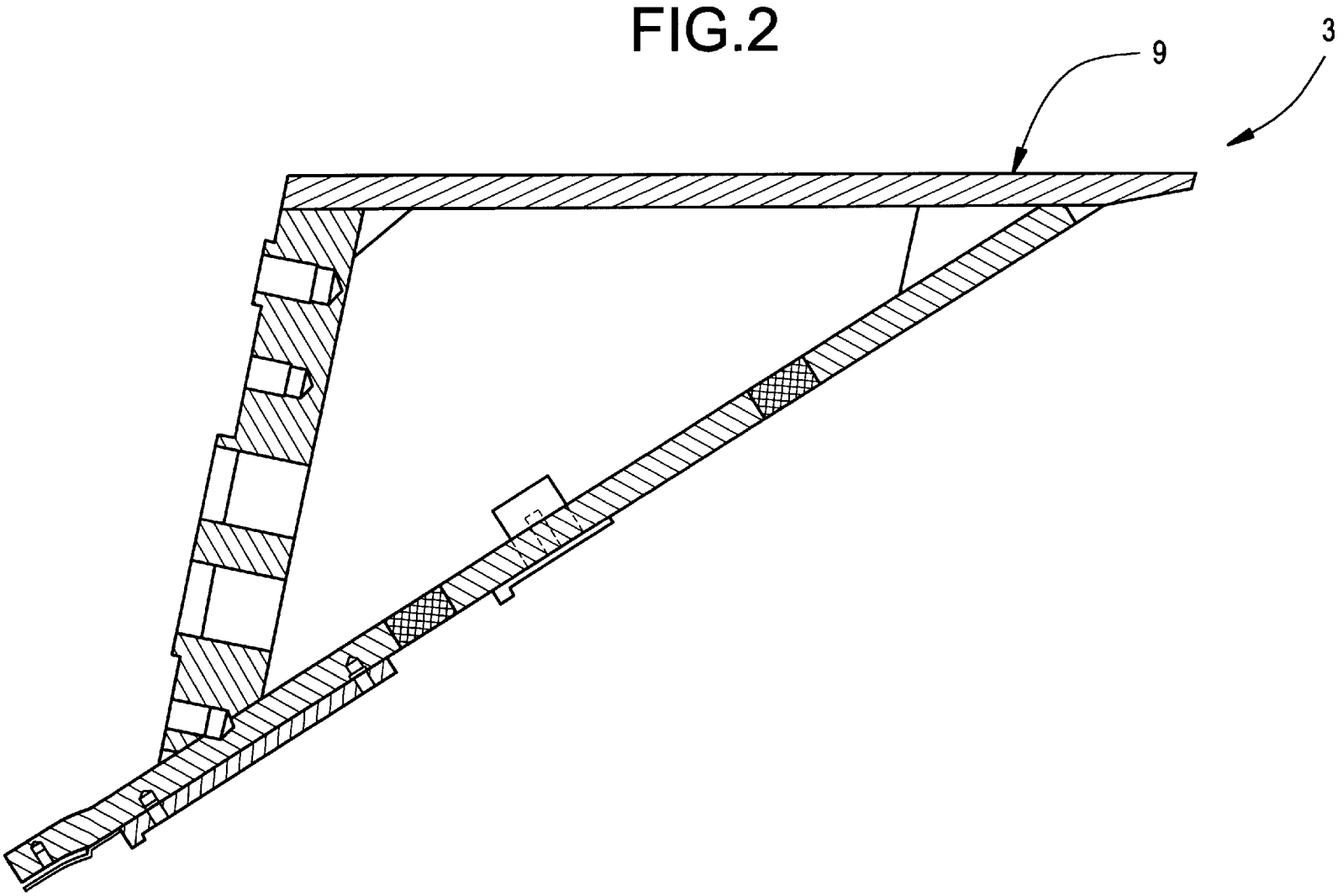
FIG. 2 is a cross-sectional view of a paper machine apron floor showing the surface to be lapped by a tool according to the present invention.

A lapping assembly shown in FIGS. 3–7 according to the present invention is used to lap, polish and finish headbox components, such as a headbox apron floor as shown in FIG. 2 of a headbox as shown in FIG. 1.

Shown in FIG. 1 is a cross-sectional view of a typical paper machine headbox slice area (1). Slice body wall (2) cooperates with a lower slice wall or apron floor (3) to determine the opening of a slice, and thus the flow of paper making stock from a headbox onto a forming wire (4) trained about a roll (5). A series of spaced adjusters (6) are positioned along an upwardly extending body wall (7) from the slice body wall (2) for incremental adjustment of the slice opening. Minute adjustments of the slice opening are accomplished by micro-adjusters (8) which operate in cooperation with the spaced adjusters (6). The spaced adjusters (6) and micro-adjusters (8) can adjust the slice opening in increments of one ten-thousandth of an inch.

Modern hydraulic headboxes are expected to control slice openings to tolerances in the order of 0.0002 inches. This requires that the slice be initially set precisely parallel to the apron floor. As described in "The Challenge, Lapping a Headbox Apron Floor", written by D. H. Offerhaus of Fletcher Challenge Canada Limited (available from the 1993 Spring Conference Canadian Pulp and Paper Association Preprints, Session 2B, Paper No. 4) state of the art measuring techniques have shown that apron floors can be wavy, in both the machine and cross-machine directions, with amplitudes in excess of 0.002 inches. A wavy apron floor has been identified to be a cause of barring, streaking or ridging of the final paper product produced by a paper machine. A wavy apron floor causes an uneven jet of paper stock to come out of a headbox, which results in basis weight streaks and produces the problems previously mentioned.

Thus, a significant feature of the present invention is to be able to lap and finish a headbox apron floor to a smoothness and flatness that heretofore has not been possible, and to do so in a quick and easy manner. The lapping tool according to the present invention enables those skilled in the art to accomplish this feature.

FIG. 2 shows an apron floor (3) of a paper machine headbox that is lapped according to the present invention. The apron floor is mounted on a floor of a milling machine (not shown) such that a top working surface (9), which the paper stock flows over, is positioned under a lapping assembly according to the present invention. The apron floor is lapped by driving the lapping assembly levelly on and over the apron floor.

Figure 3:
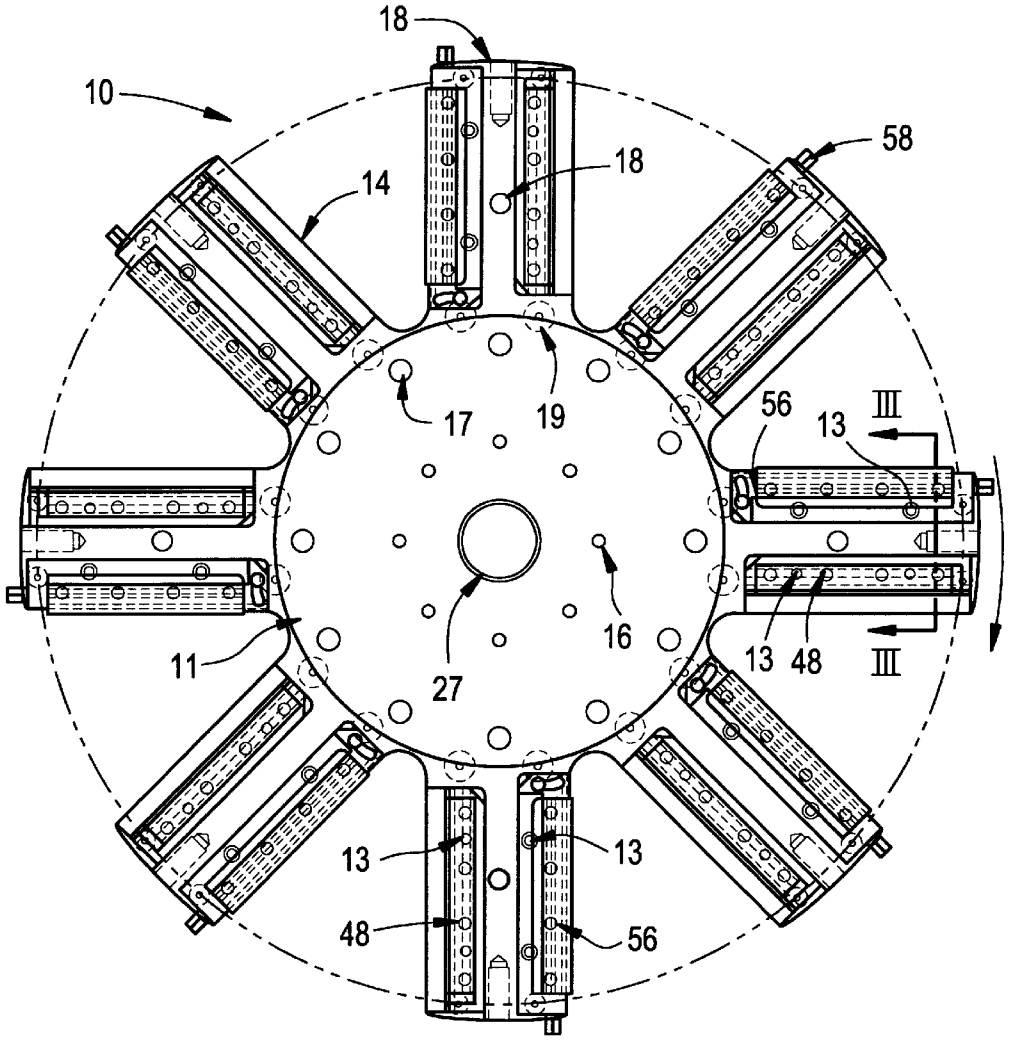
FIG. 3 is a plan view of a lapping fly plate according to the present invention.

FIG. 3 shows a plan view of one embodiment of a lapping fly wheel (10) according to the present invention. The lapping fly wheel (10) consists of a center hub (11) with eight axially extending spokes (14) located around the periphery of the center hub (11). The spokes (14) hold abrasive and lapping materials which will be more fully described in conjunction with FIGS. 5 and 6. The lapping fly wheel (10) is connected to a spring loaded floating driver (20) shown in FIG. 7 via bolts (25) shown in FIG. 7 being inserted in the spring loaded floating driver (20) and further inserted through holes (16) of the lapping fly wheel (10). Tapped holes (18) are used for lifting and maneuvering the lapping fly wheel (10) in to or out of position. A lapping fly wheel (10) having a diameter of 36–38 inches and made of aluminum typically weighs between 200–300 pounds. A lapping fly wheel typically ranges from approximately 150–500 pounds depending on the type of material used and the diameter of the lapping wheel. Eye bolts (not shown) can be placed in the tapped holes (18) and connected to an overhead crane so that the lapping wheel can be moved as needed. Once the lapping fly wheel (10) and spring loaded floating driver (20) are connected to the milling machine and ready for operation, lubricants such as water or oil, depending on what is appropriate for a particular lapping operation, flood the top part of the working surface (9) of the apron floor (3) through holes (17) in the lapping fly wheel (10). Because the lapping fly wheel (10) is positioned above the apron floor (3), protective button pads (19) made of soft material are provided on the bottom surface of the center hub (11) of the lapping fly wheel (10). If, for whatever reason, the lapping fly wheel (10) falls on top of the apron floor (3), the protective button pads (19) will prevent the working surface (9) of the apron floor (3) from being damaged.

Figure 5:
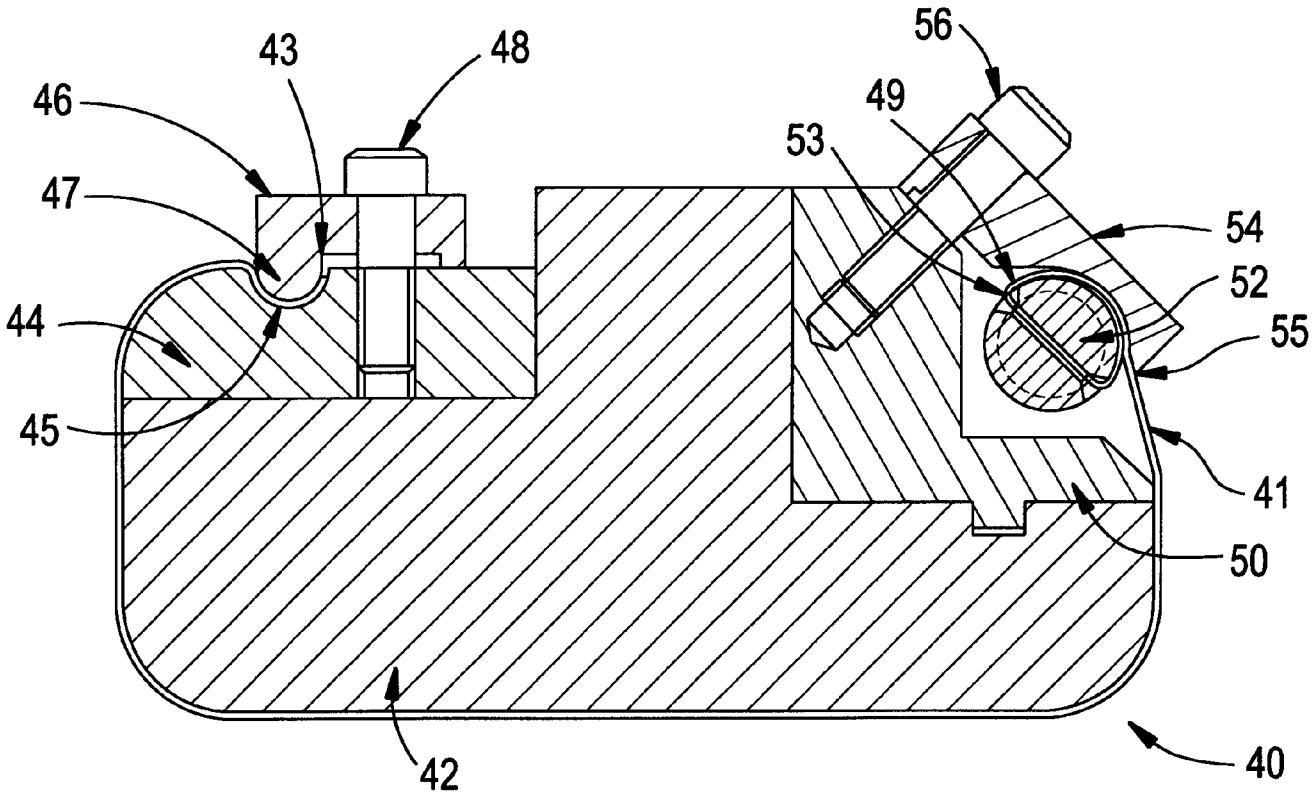
FIG. 5 is a cross-sectional view taken along line III—III of FIG. 3, showing one embodiment of an abrasive pad holder according to the present invention.

Shown in FIG. 5 is a cross-section taken along line III—III of FIG. 3, showing one embodiment of an abrasive pad holder (40) according to the present invention. The body (42) holds abrasive grinding and lapping material (41). The abrasive and grinding material is commercially available, coated abrasive sand paper cut in short rectangular sections and is available generally from suppliers such as Norton, Cincinnati or Carborundum. Different grits may be used depending on the type of finish to be obtained and the material being lapped, as those skilled in the art will recognize.

Attached to the leading side of the body (42) is a base clamp pad (44). The base clamp pad (44) positions a front end (43) of the abrasive strip (41). The front end (43) of the abrasive strip sits in a concave dimple (45) of the base clamp pad (44). A base clamp (46) clamps the front end (43) of the abrasive strip (41) to the base clamp pad (44) by virtue of a protrusion (47) which mates with the concave dimple (45) when hold down screws (48) attach the base clamp (46) to the base clamp pad (44). The base clamp pad (44) and a tightener roll holder (50) (described below) are attached to body (42) by screws (13) shown in FIG. 3.

Attached to the trailing side of the body (42) is a tightener roll holder (50). The tightener roll holder (50) includes a tightener roll (52). A back end (49) of the abrasive strip (41) is placed around the tightener roll (52). The abrasive strip is held into position by a tightener roll clamp (54). The tightener roll clamp (54) has a bottom surface (55) which is formed to mate with the tightener roll (52) when the tightener roll clamp (54) is tightened against the tightener roll (52) via hold down screws (56). The tightener roll (52) pulls the abrasive strips (41) tight by rolling the back end (49) of the abrasive strips (41) around the tightener roll's circumference. The back end (49) of the abrasive strip (41) is placed and secured in position in slot (53) of the tightener roll (52). The abrasive strip (41) is tightened around the tightener roll (52) by knob (58) (shown in FIGS. 3 and 4). Rotating the knob (58) counter-clockwise or clockwise will, respectively, either tighten or loosen the abrasive strip (41) around the tightener roll (52) as needed.

To remove and change the abrasive paper (41), hold down screws (48) and (56) are loosened so that the base clamp (46) and tightener roll clamp (54) are released from the base clamp pad (44) and tightener roll holder (50) respectively. The old abrasive paper (41) is removed. To install the new abrasive paper (41) to the abrasive pad holder (40), the procedure just described is reversed.

Figure 4:
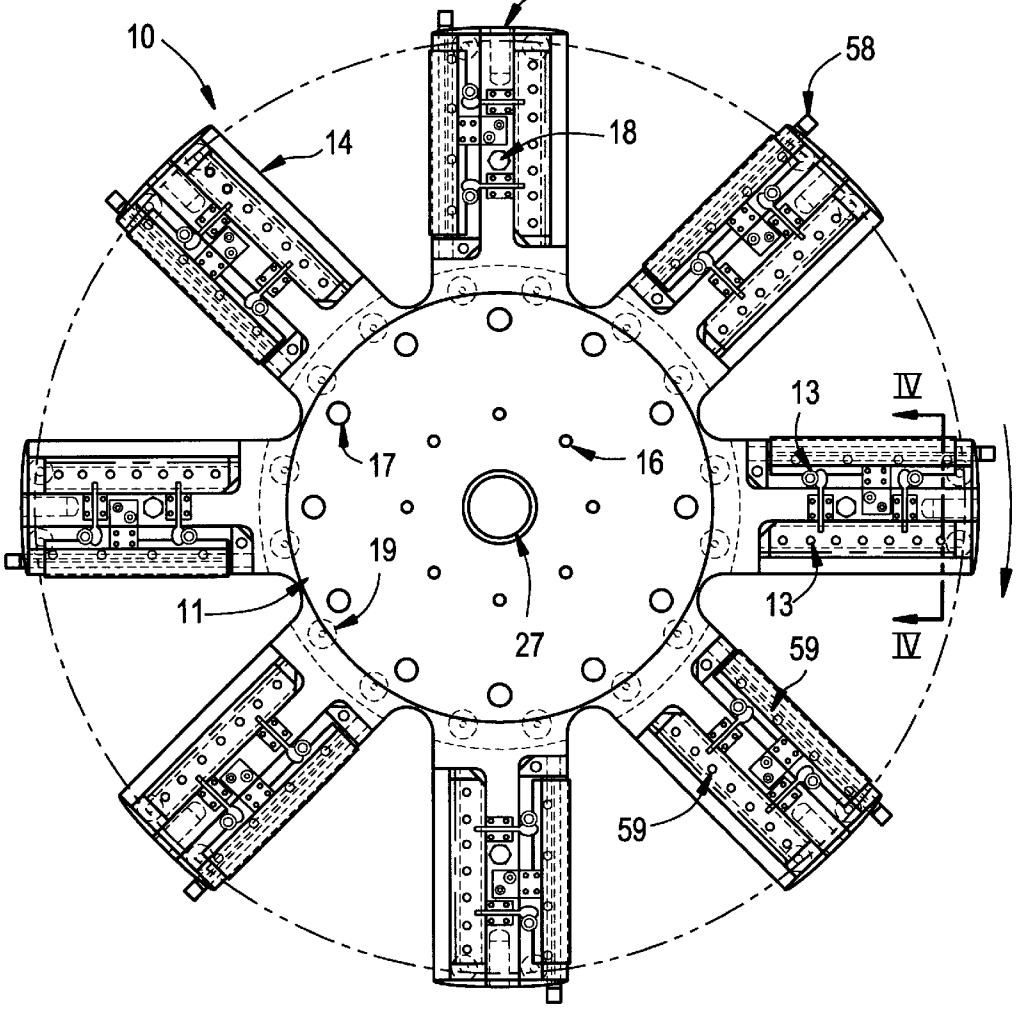
FIG. 4 is plan view of a further embodiment of a lapping fly plate of the present invention.
Figure 6:
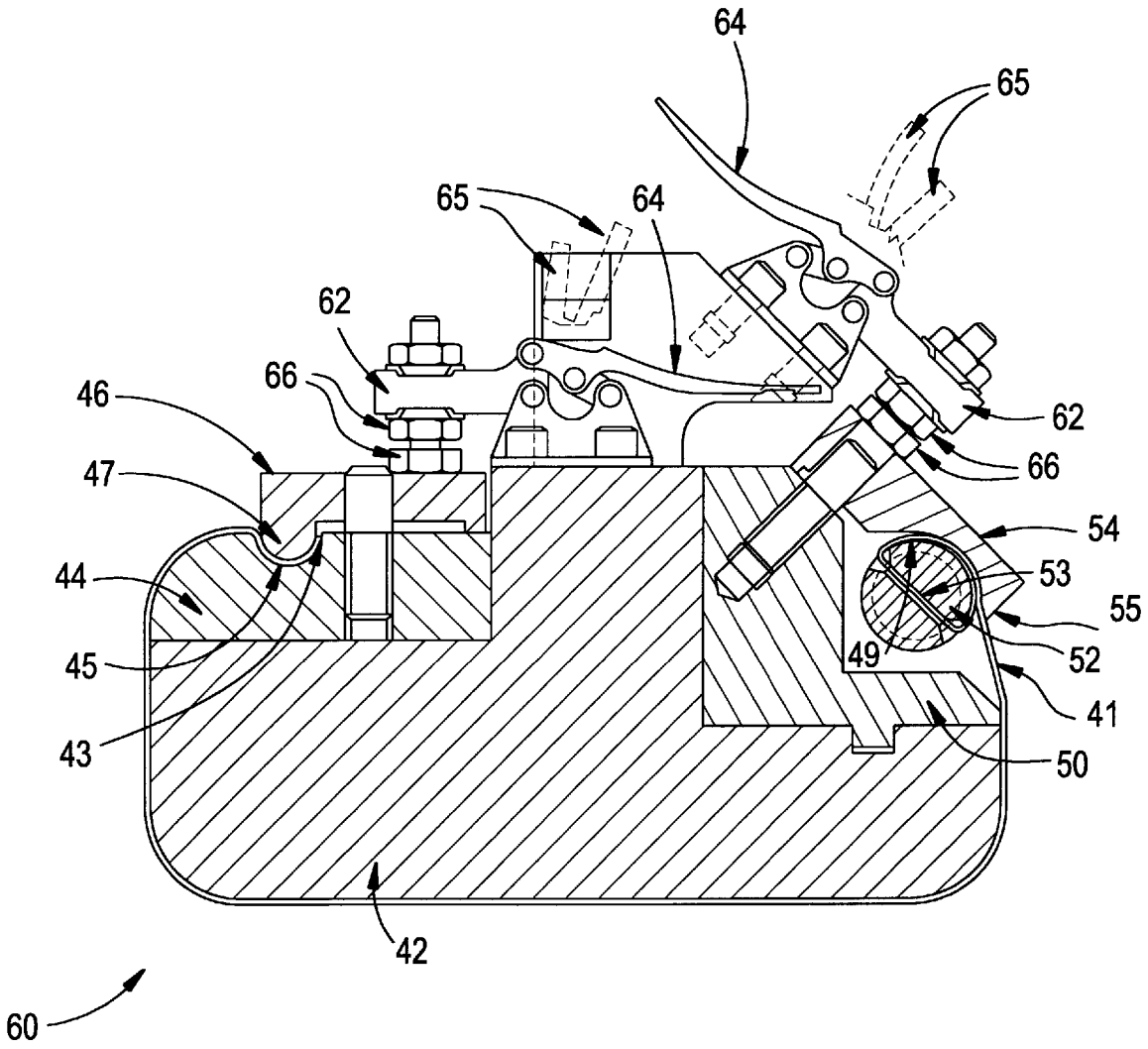
FIG. 6 is a cross-sectional view taken along line IV—IV of FIG. 4, showing another embodiment of an abrasive pad holder according to the present invention.

FIG. 4 shows a plan view of another embodiment of a lapping fly wheel (10) according to the present invention. Shown in FIG. 6 is a cross-section taken along line IV—IV of FIG. 4 showing another embodiment of an abrasive pad holder (60) according to the present invention. The same or similar parts will be labeled and described with the same reference numerals as previously used.

The hold down screws (48) and (56) of the abrasive pad holder (40) described in reference to FIGS. 3 and 5 are replaced with toggle clamps (62) in the abrasive pad holder (60) shown in FIG. 6.

The toggle clamps (62) include levers (64) and adjustable hex-head spindles (66). Toggle clamps that are suitable for use can be obtained from CarrLane Manufacturing Company. One toggle clamp suitable for use is sold under the brand name CL-250-VTC. The hex-head spindles are available from the same company. It should be noted that other spindles such as flat-cushion or cone-cushion spindles are appropriate for use instead of hex-head spindles and are also available from the same company.

To hold the base clamp (46) and tightener roll clamp (54) against the base clamp pad (44) and tightener roll (52), the hex-head spindles (66) are forced against the top surfaces of the base clamp (46) and tightener roll clamp (54) when the levers (64) of the toggle clamps (62) are engaged (shown in solid lines in FIG. 6). The pressure exerted on the base clamp (46) and tightener roll clamp (54) by the toggle clamps (62) holds the clamps against the base clamp pad (44) and tightener roll (52) respectively, thereby securing the abrasive strip of paper (41) to the abrasive pad holder (60). To release the clamps (46) and (54), thus enabling one to remove and change the abrasive paper (41), the levers (64) are disengaged (shown in dashed lines (65) in FIG. 6). The levers can be engaged and disengaged by hand. Although the levers (64) are easily engaged and disengaged, when the levers (64) are engaged, the toggle clamps (62) provide sufficient force and strength to hold the abrasive paper (41) in place such that it does not fall out or become loose during normal operating lapping conditions.

The toggle clamps (62) provide an advantage over the hold down screws (48) and (56) of the abrasive pad holder (40) in that to remove old abrasive pads and install new abrasive pads for the abrasive pad holder (60), only levers (64) have to be actuated or deactuated; unlike the changing operation of abrasive pad holder (40) which requires the loosening and tightening of numerous screws. The change out procedure used in conjunction with the toggle clamps (62) is much more efficient and convenient than the change out procedure used in conjunction with the hold down screws (48) and (56).

As shown in FIG. 4, the guide holes (59) are drilled into the base clamp (46) and tightener roll clamp (54). Guide pins (not shown) are mounted in the base clamp pad (44) and tightener roll holder (50) and are placed into the holes (59) to properly line up and help locate the base clamp (46) and tightener roll clamp (54) to the body (42) of the abrasive pad holder (60).

Figure 7:
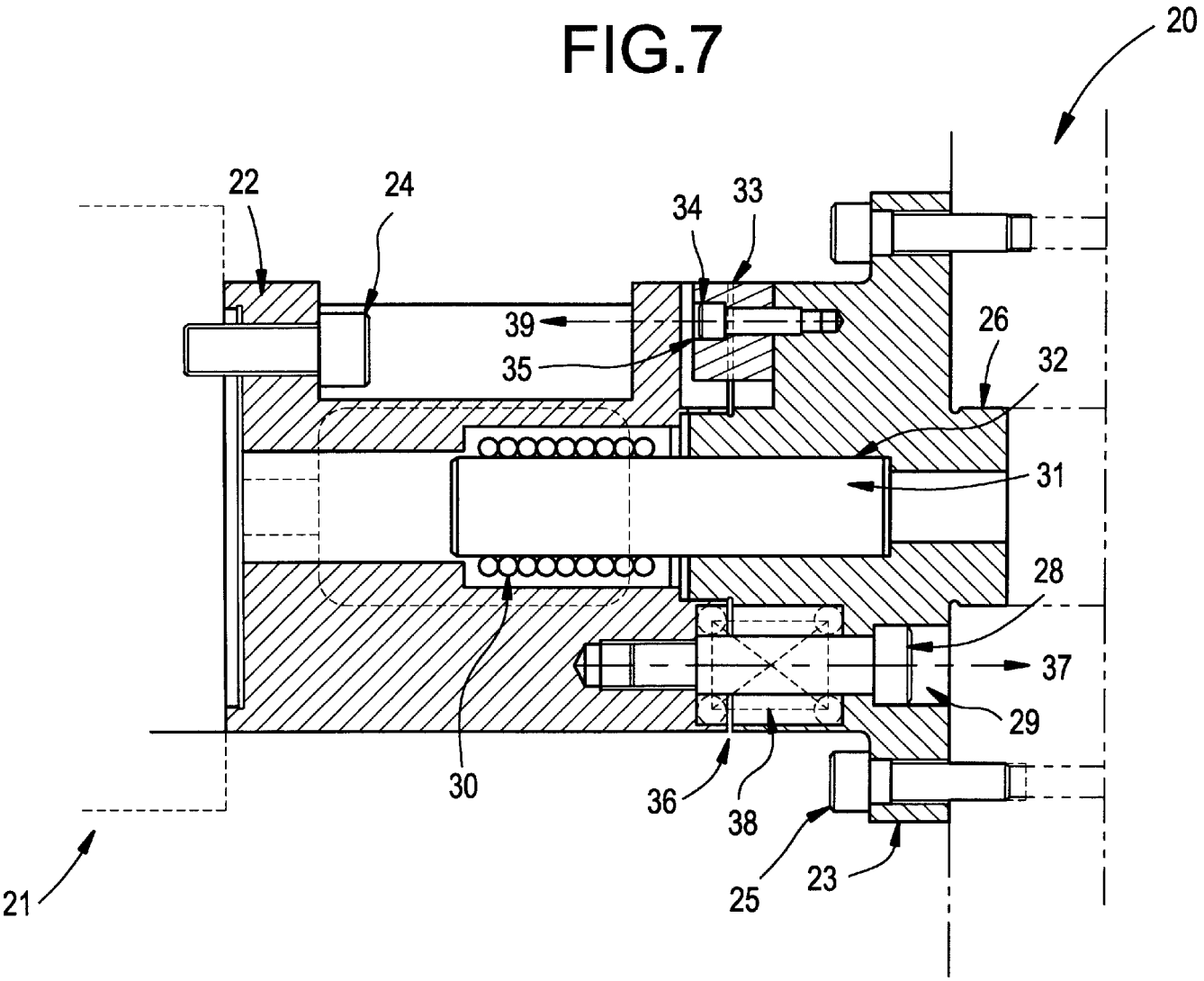
FIG. 7 is a cross-sectional view of a spring loaded floating driver according to the present invention.

FIG. 7 is a cross-sectional view of a spring loaded floating driver (20) according to the present invention. The milling machine previously mentioned contains a spindle or drive device (21) schematically shown in FIG. 7. The spring loaded floating driver (20) includes a spindle adapter (22) and a lapping fly wheel adapter (23). The spindle adapter (22) is attached to the drive device (21) of the milling machine by use of attaching screws (24). The lapping fly wheel adapter (23) includes a flange (26). The flange (26) slidably engages with a hole (27) (shown in FIGS. 3 and 4) of the lapping fly wheel (10). The lapping fly wheel adapter (23) is attached to the lapping fly wheel by attaching screws (25). Attaching screws (25) are screwed into holes (16) (shown in FIGS. 3 and 4) of the lapping fly wheel (10).

The spring loaded floating driver (20) includes pressure springs (38). Such pressure springs can be standard heavy load springs of rectangular wire construction available from Danly in various sizes depending on the amount of force to be exerted by the springs. Located through the center of the springs (38) is a shoulder screw (28). The head of the shoulder screw (28) sits in a depression (29) in the lapping fly wheel adapter (23).

The spring loaded floating driver (20) includes a high-precision guide bushing and pin assembly (30) available from Thompson. The bushing and pin assembly (30) includes precision steel ball bushing bearings. Essentially, the guide bushing and pin assembly (30) provides concentric alignment of the spindle adapter (22) and the lapping fly wheel adapter (23). Pin (31) of the assembly (30) is received by pin hole (32) in the lapping fly wheel adapter (23).

The spring loaded floating driver (20) includes drive keys (33). The drive keys (33) are attached to the lapping fly wheel adapter (23) by shoulder screws (34). The head of the shoulder screw (34) sits in a depression (35) in the drive keys (33). The drive keys (33) fit into a slot (not shown) found in the spindle adapter (22) when the spindle adapter (22) is connected to the lapping fly wheel adapter (23). The drive keys (33) provide the means by which the lapping fly wheel adapter (23) is driven when the drive device (21) of the milling machine is spinning.

The spring loaded floating driver (20) operates as follows. The spindle adapter (22) is connected to the drive device (21) of a milling machine. As the drive device (21) rotates, the spindle adapter (22) rotates. The pin (31) of the guide bushing and pin assembly (30) slides into the hole (32) of the lapping fly wheel adapter (23). If the spring loaded floating driver (20) did not include drive keys (33), the spindle adapter (22) would rotate as the drive device (21) rotates, but the lapping fly wheel adapter (23) would not rotate. In other words, the pin (31) would spin freely in the hole (32). Thus, the drive keys (33) provide the means to drive the lapping fly wheel adapter (23) as the drive device (21) spins. The pressure springs (38) are located between the spindle adapter (22) and lapping fly wheel adapter (23) and held in place by shoulder screws (28). Shown in FIG. 7, is a gap (36) of approximately 1/16 of an inch. The gap (36) is shown when the spring loaded floating driver (20) is not operating. The pressure springs (38) are preloaded such that the spring loaded floating driver (20) is designed to provide this approximate 1/16 of an inch gap when nonoperating.

In the use and operation of the lapping assembly, the whole operation consists of attaching the spring loaded floating driver (20) to the machine spindle or drive (21) on a milling machine. The lapping fly wheel (10) is attached to the spring loaded floating driver (20). The coated abrasive strip (41), with desired grit size to achieve the desired finish results, is clamped in place to the lapping fly wheel (10). The machine spindle (21) is rotated and the whole assembly starts rotating. The apron floor (3) is placed under the lapping fly wheel (10) and the lapping fly wheel (10) is brought into contact with the apron floor working surface (9) to lap and finish the apron floor.

As the lapping assembly, which includes the lapping fly wheel (10) and spring loaded floating driver (20), is brought into contact with the working surface (9) of the apron floor (3), the pressure springs (38) are further compressed. The gap (36) closes to about a distance of 1/32 of an inch and the shoulder screws (28) and (34) slide in the direction of arrows (37) and (39) respectively within the depressions (29) and (35) respectively approximately the same 1/32 of an inch. The pressure springs (38), which apply pressure between the lapping fly wheel (10) and the apron surface (9) being lapped, allow the operator flexibility in determining how much pressure to exert between the surface being lapped and the lapping tool.

The guide bushing and pin assembly shown in FIG. 7 is an integral part of the lapping assembly according to the present invention. The lapping fly wheel adapter (23) and the spindle adapter (22) must line up correctly in order for the lapping assembly to operate correctly. If the spindle adapter (22) and the lapping fly wheel adapter (23) are not linearly connected, the spring loaded floating driver (20) will tilt or cock during operation. Such tilting or cocking could result in the lapping fly wheel (10) gouging the apron surface (9) being lapped. Such damage is unacceptable and the lapping assembly would be virtually useless.

Figure 8:
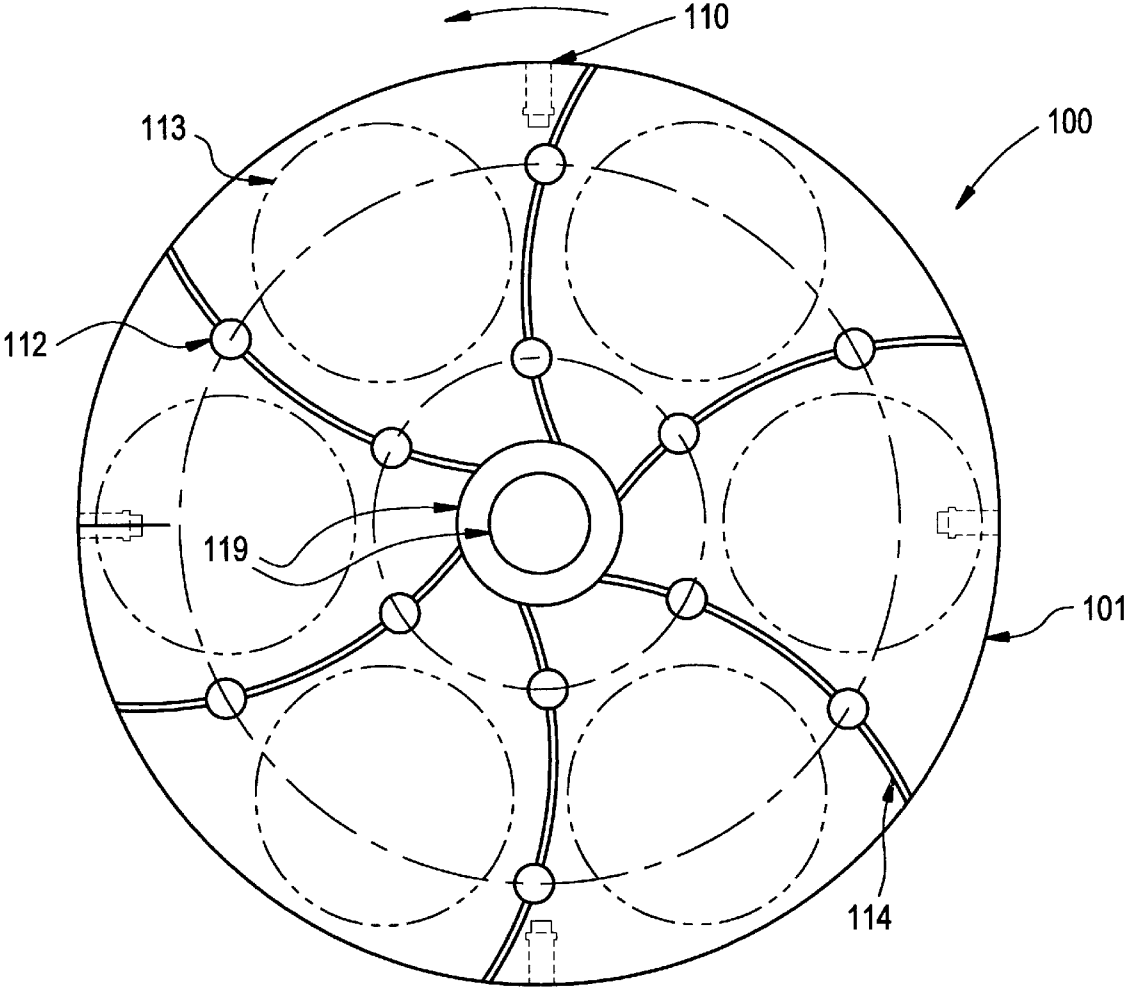
FIG.8 PRIOR ART
FIG. 8 is a plan view of a prior art lapping device.

FIG. 8 shows a prior art lapping tool as described in the Description of the Prior Art. The lapping tool (100) includes a solid, one-piece, circular plate (101). The prior art lapping plate further includes tapped holes (110) for assisting in maneuvering the plate (101) in to and out of position. Holes (112) for flooding a surface to be lapped with lubricant are provided through the plate (101). Associated with the holes (112) are grooves (114) allowing the lubricant to escape thereby preventing the plate (101) from being suctioned into the surface to be lapped. The previously mentioned circular daisy sand paper disks (113) are adhesively attached to the lapping plate. It has been found that in operation these daisy pads fail to adhere properly to the lapping tool and fall off during operation. This, of course, provides an unsatisfactory condition in lapping processes. The lapping tool of the present invention is designed to overcome the problems associated with this prior art lapping tool.

The prior art lapping tool shown in FIG. 8 previously used a nonspring loaded floating drive mechanism (not shown) attached to the plate via holes (119) of the plate (101). Such a drive device did not include the pressure springs, guide bushing and pin assembly and drive keys described in conjunction with the present invention. It has been found that such a prior art drive device, at times, damaged apron surfaces when brought in to contact with such surfaces. Because the prior art drive device does not have any give or play by way of the pressure springs, if the operator applies too much pressure on the surface or engages the surface too quickly, the apron floor surface can be gouged. If gouged, the piece must be fixed which entails extra cost and machining time as previously discussed. Thus, another feature of the present invention is to remedy this problem associated with prior art lapping tools.

While an apparatus for lapping and finishing a surface of a headbox component has been shown and described in detail herein, various changes may be made without departing from the scope of the present invention.

I claim:

1. A lapping assembly for lapping a surface, said lapping assembly comprising:

a circular lapping fly wheel having a center hub;

a plurality of abrasive pad holders spaced around and extending axially from a periphery of the center hub of said lapping fly wheel, said abrasive pad holders having abrasive material to be used for lapping the surface;

a drive device; and a spring loaded floating driver adapted to be mounted between said drive device and lapping fly wheel such that when said spring loaded floating driver is rotated by said drive device, said lapping fly wheel rotates, thereby enabling said lapping fly wheel to lap and finish the surface when brought into contact with the surface.

2. A lapping assembly as set forth in claim 1, wherein said abrasive pad holders further comprise:

a base clamp pad for receiving an abrasive strip;

a base clamp for receiving and clamping a front end of said abrasive strip;

a tightener roll for receiving a back end of said abrasive strip;

a tightener roll holder, said tightener roll attached to said tightener roll holder;

a tightener roll clamp for clamping said back end of said abrasive strip to said tightener roll;

means for clamping a front end of the abrasive material between the base clamp pad and base clamp; and means for clamping a back end of the abrasive material between the tightener roll and tightener roll clamp, said means for clamping also enabling the abrasive material to be removed or installed as needed.

3. A lapping assembly as set forth in claim 2, wherein said means for clamping the abrasive material includes hold down screws.

4. A lapping assembly as set forth in claim 2, wherein said means for clamping the abrasive material includes toggle clamps.

5. A lapping assembly as set forth in claim 2, wherein each said tightener roll includes an adjusting knob for rotating said tightener roll for tightening or loosening abrasive material to each said respective abrasive pad holder.

6. A lapping assembly as set forth in claim 1, wherein the center hub of said lapping fly wheel further includes holes therethrough for allowing lubricant to pass between said lapping fly wheel and the surface being lapped.

7. A lapping assembly as set forth in claim 1, wherein there are eight, equally-spaced, axially-extending, abrasive pad holders located around the periphery of the center hub.

8. A lapping assembly as set forth in claim 1 wherein protective button pads are positioned on the center hub between said lapping fly wheel and the surface to be lapped.

9. A lapping assembly as set forth in claim 1, where said spring loaded floating driver further comprises:

a spindle adapter for mounting to a rotating mechanism of a milling machine;

a lapping fly wheel adapter fixedly attached to said lapping fly wheel; said lapping fly wheel adapter having a hole therethrough; said lapping fly wheel adapter further having a depression therein; and said lapping fly wheel adapter including a flange thereon;

a pressure spring located between said spindle adapter and said lapping fly wheel adapter;

a pressure spring shoulder screw passing through the center of said pressure spring and having a head whereby the head of said pressure spring shoulder screw is located in the depression of said lapping fly wheel and the other end of said pressure spring shoulder screw is screwed into said spindle adapter;

a guide bushing and pin assembly mounted within said spindle adapter; said assembly including a pin which is received by the hole of said lapping fly wheel when said spindle adapter and said lapping wheel adapter are assembled together;

a drive key attached to said lapping fly wheel adapter; said drive key having a top surface with a depression therein;

a drive key shoulder screw for attaching said drive key to said lapping fly wheel adapter; said drive key shoulder screw including a head which is located within the depression of the top surface of said drive key when said drive key shoulder screw is used to attach said drive key to said lapping fly wheel adapter; said drive key further fitting into a slot in said spindle adapter when said spindle adapter and said lapping fly wheel adapter are assembled together; whereby said drive key provides the means by which said lapping fly wheel adapter and thereby said lapping fly wheel are rotated when said spindle adapter is rotated.

* * * * *